US006659880B1

(12) United States Patent
Hsieh

(10) Patent No.: US 6,659,880 B1
(45) Date of Patent: Dec. 9, 2003

(54) LINEAR PUTTER DEVICE OF A GOLF CLUB

(76) Inventor: Fu-Hu Hsieh, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/341,063

(22) Filed: Jan. 10, 2003

(51) Int. Cl.[7] ..... A63B 69/36
(52) U.S. Cl. ..... 473/226; 473/223
(58) Field of Search ..... 473/206, 219, 473/226, 231, 238, 239, 212, 257, 276

(56) References Cited

U.S. PATENT DOCUMENTS 5,328,185 A * 7/1994 Finnigan et al. ..... 473/294
5,649,870 A * 7/1997 Harrison ..... 473/239
5,904,624 A * 5/1999 Martinez ..... 473/212
6,358,156 B1 * 3/2002 Moran ..... 473/219
6,447,402 B2 * 9/2002 Moran ..... 473/226
6,533,676 B1 * 3/2003 D'Angelo et al. ..... 473/239
6,569,030 B1 * 5/2003 Hamilton ..... 473/257

* cited by examiner

*Primary Examiner*—Paul T. Sewell
*Assistant Examiner*—Nini F. Legesse

(57) ABSTRACT

A linear putter device of a golf club includes a lower connecting rod, an upper connecting rod, a bearing unit, a locking member, an upright rod, and a movable member. Thus, the golf club is moved in a linear manner, so that the golf club can hit the golf ball in a linear manner. in addition, the distance between the movable member and the upright rod can be adjusted arbitrarily so as to fit the user's stature and height, so that the length of the golf club can fit the user's stature and height.

18 Claims, 8 Drawing Sheets

LINEAR PUTTER DEVICE OF A GOLF CLUB

BACKGROUND OF THE INVENTION

1. Field of the Invention

The present invention relates to a linear putter device of a golf club, and more particularly to a linear putter device of a golf club, wherein the golf club is moved in a linear manner, so that the golf club can hit the golf ball in a linear manner without deflection.

2. Description of the Related Art

The golf club includes a putter that can be used to hit the golf ball in a linear and straight manner. Thus, the putter has to be in line with the target, so that the golf can reach the target actually. However, operation of the putter is controlled by the user, so that the putter is not easily in line with the target due to deflection of the hitting angle of the putter, thereby causing deflection of the golf ball from the target.

SUMMARY OF THE INVENTION

The primary objective of the present invention is to provide a linear putter device of a golf club, wherein the golf club is moved in a linear manner, so that the golf club can hit the golf ball in a linear manner.

Another objective of the present invention is to provide a linear putter device of a golf club, wherein the golf club produces an oscillation motion like a pendulum.

A further objective of the present invention is to provide a linear putter device of a golf club, wherein the distance between the movable member and the upright rod can be adjusted arbitrarily so as to fit the user's stature and height, so that the length of the golf club can fit the user's stature and height In accordance with the present invention, there is provided a linear putter device of a golf club, comprising a lower connecting rod, an upper connecting rod, a bearing unit, a locking member, an upright rod, and a movable member, wherein:

the lower connecting rod has a lower end formed with an insertion section and an upper end formed with a pivot section, the pivot section of the lower connecting rod has an upper portion which has a first half formed with an arc-shaped insertion recess and a second half formed with a pivot seat, the pivot seat of the lower connecting rod has an inner wall formed with an annular insertion groove, the pivot section of the lower connecting rod has a lower portion formed with a receiving chamber for receiving two first locking balls and a first compression spring;

the upper connecting rod is pivotally mounted on the lower connecting rod and has an upper end formed with an insertion section and a lower end formed with a pivot section pivotally mounted on the pivot section of the lower connecting rod, the pivot section of the upper connecting rod has a lower portion which has a first half formed with an arc-shaped insertion recess for insertion of the pivot seat of the lower connecting rod and a second half formed with a pivot seat inserted into the insertion recess of the lower connecting rod, the pivot seat of the upper connecting rod has an inner wall formed with an annular insertion groove, the pivot section of the upper connecting rod has an upper portion formed with a receiving chamber for receiving two second locking balls and a second compression spring;

the bearing unit is mounted in the annular insertion groove of the lower connecting rod and the annular insertion groove of the upper connecting rod;

the locking member is detachably mounted on the lower connecting rod and the upper connecting rod, and has an inner wall having a lower end formed with an annular insertion groove for insertion of the two first locking balls and an upper end formed with an annular insertion groove for insertion of the two second locking balls;

the upright rod has a lower end extended through the locking member and secured on the upper connecting rod; and the movable member is slidably mounted on the upright rod.

Further benefits and advantages of the present invention will become apparent after a careful reading of the detailed description with appropriate reference to the accompanying drawings.

DETAILED DESCRIPTION OF THE INVENTION

Figure 1:
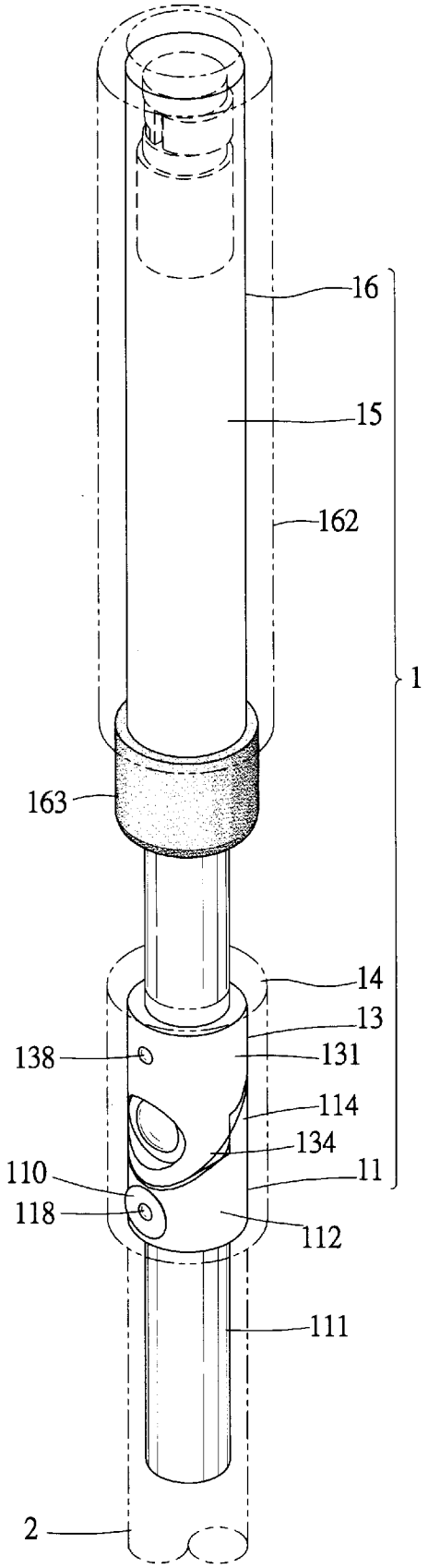
FIG. 1 is a perspective view of a linear putter device of a golf club in accordance with the preferred embodiment of the present invention!
Figure 2:
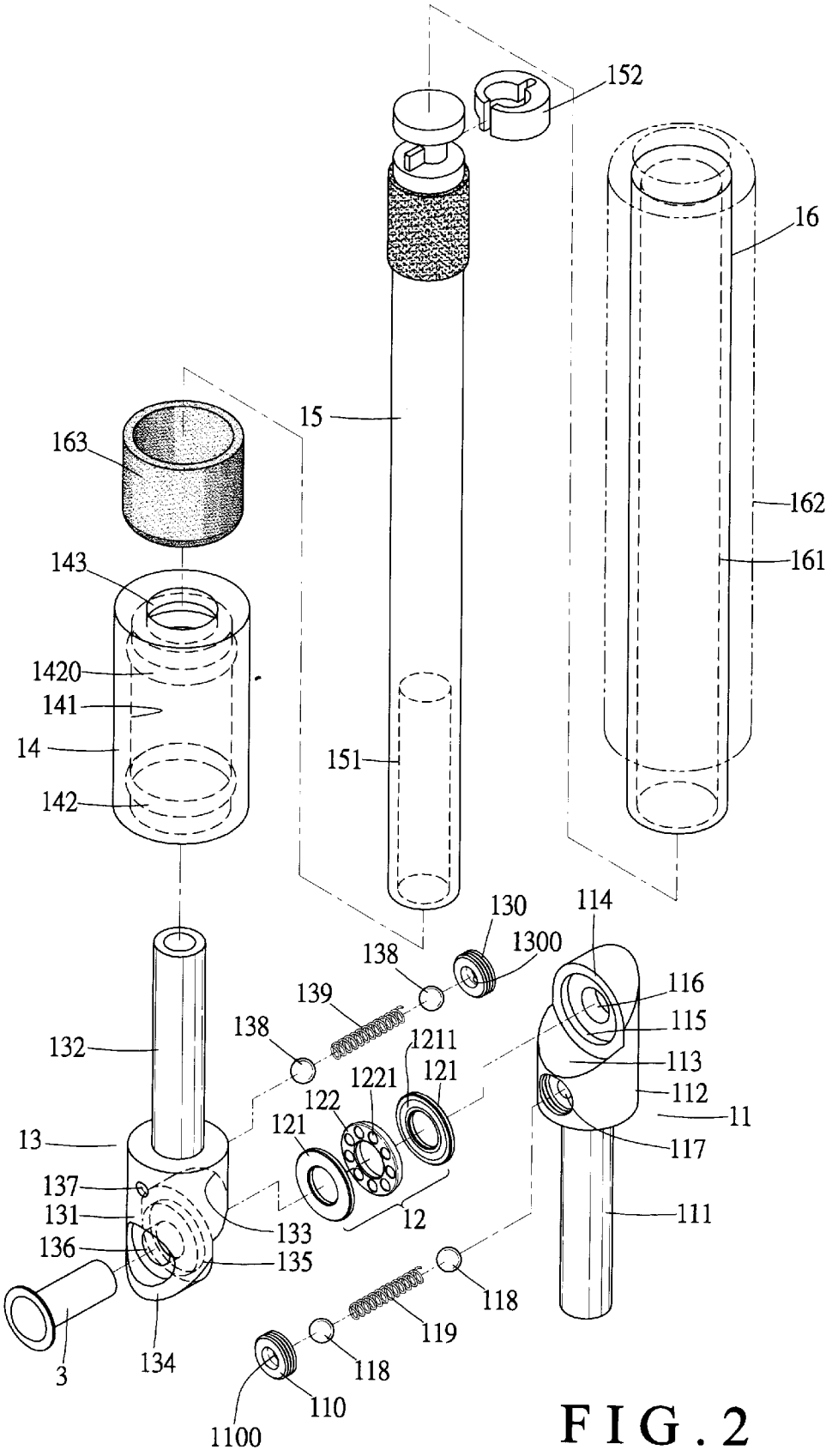
FIG. 2 is an exploded perspective view of the linear putter device of a golf club in accordance with the preferred embodiment of the present invention.

Referring to the drawings and initially to FIGS. 1–4, a linear putter device 1 in accordance with the preferred embodiment of the present invention is mounted on the top end of a golf club 2 to control the putter, so that the putter is used to hit the golf ball in a linear manner without deflection.

The linear putter device 1 in accordance with the preferred embodiment of the present invention comprises a lower connecting rod 11, an upper connecting rod 13, a bearing unit 12, a locking member 14, an upright rod 15, and a movable member 16.

The lower connecting rod 11 has a lower end formed with an insertion section 111 and an upper end formed with a pivot section 112. The insertion section 111 of the lower connecting rod 11 is inserted into the top end of the golf club 2. The pivot section 112 of the lower connecting rod 11 has an upper portion which has a first half formed with an arc-shaped insertion recess 113 and a second half formed with a pivot seat 114. The pivot seat 114 of the lower connecting rod 11 has an inner wall formed with an annular insertion groove 115. The pivot seat 114 of the lower connecting rod 11 has a center formed with a through hole 116. The pivot section 112 of the lower connecting rod 11 has a lower portion formed with a receiving chamber 117 for receiving two first locking balls 118 and a first compression spring 119 which is urged between the two first locking balls 118. A threaded first end cap 110 is screwed into an outer end of the receiving chamber 117 of the lower connecting rod 11. The first end cap 110 is formed with a through hole 1100 for allowing protrusion of one of the two first locking balls 118.

The upper connecting rod 13 is pivotally mounted on the lower connecting rod 11 and has an upper end formed with an insertion section 132 and a lower end formed with a pivot section 131 pivotally mounted on the pivot section 112 of the lower connecting rod 11. The pivot section 131 of the upper connecting rod 13 has a lower portion which has a first half formed with an arc-shaped insertion recess 133 for insertion of the pivot seat 114 of the lower connecting rod 11 and a second half formed with a pivot seat 134 inserted into the insertion recess 113 of the lower connecting rod 11. The pivot seat 134 of the upper connecting rod 13 has an inner wall formed with an annular insertion groove 135. The pivot seat 134 of the upper connecting rod 13 has a center formed with a through hole 136 for passage of a pivot pin 3 which is extended through the through hole 116 of the lower connecting rod 11, so that the upper connecting rod 13 is pivotally mounted on the lower connecting rod 11. The pivot section 131 of the upper connecting rod 13 has an upper portion formed with a receiving chamber 137 for receiving two second locking balls 138 and a second compression spring 139 which is urged between the two second locking balls 138. A threaded second end cap 130 is screwed into an outer end of the receiving chamber 137 of the upper connecting rod 13. The second end cap 130 is formed with a through hole 1300 for allowing protrusion of one of the two second locking balls 138.

The bearing unit 12 is mounted between the lower connecting rod 11 and the upper connecting rod 13. The bearing unit 12 is mounted in the annular insertion groove 115 of the lower connecting rod 11 and the annular insertion groove 135 of the upper connecting rod 13. The bearing unit 12 includes two annular washers 121 and a roller race 122 mounted between the two annular washers 121. Each of the two annular washers 121 of the bearing unit 12 is formed with an annular groove 1211. The roller race 122 of the bearing unit 12 is provided with a plurality of rollers 1221 rotatably mounted in the annular groove 1211 of each of the two annular washers 121. The annular washers 121 and the roller race 122 of the bearing unit 12 are laminated together.

The locking member 14 is detachably mounted on the lower connecting rod 11 and the upper connecting rod 13. The locking member 14 has an inner wall formed with a mounting hole 141 for receiving the pivot section 112 of the lower connecting rod 11 and the pivot section 131 of the upper connecting rod 13. The locking member 14 has an upper end face formed with a passage hole 143 communicating with the mounting hole 141. The inner wall of the locking member 14 has a lower end formed with an annular insertion groove 142 for insertion of the two first locking balls 118 and an upper end formed with an annular insertion groove 1420 for insertion of the two second locking balls 138.

The upright rod 15 is mounted on the upper connecting rod 13. The upright rod 15 has a lower end extended through the passage hole 143 of the locking member 14. The lower end of the upright rod 15 is formed with a mounting hole 151 for insertion of the insertion section 132 of the upper connecting rod 13. An elastic ring 152 is mounted on an upper end of the upright rod 15.

The movable member 16 is slidably mounted on the upright rod 15 and has an inner wall formed with a receiving hole 161 for receiving the upright rod 15. A soft rubber grip 162 is mounted on an outer wall of the movable member 16. A catch ring 163 is slidably mounted on the upright rod 15 and is secured on a lower end the movable member 16 to move therewith.

In assembly, the two first locking balls 118 and the first compression spring 119 are in turn inserted into and received in the receiving chamber 117 of the lower connecting rod 11. Then, the first end cap 110 is screwed into the outer end of the receiving chamber 117 of the lower connecting rod 11. Thus, the two first locking balls 118 are partially protruded outward from the outer wall of the pivot section 112 of the lower connecting rod 11. Then, the insertion section 111 of the lower connecting rod 11 is inserted into the top end of the golf club 2, so that the lower connecting rod 11 is combined with the golf club 2. Then, the two second locking balls 138 and the second compression spring 139 are in turn inserted into and received in the receiving chamber 137 of the upper connecting rod 13. Then, the second end cap 130 is screwed into the outer end of the receiving chamber 137 of the upper connecting rod 13. Thus, the two second locking balls 138 are partially protruded outward from the outer wall of the pivot section 131 of the upper connecting rod 13.

Then, each of the two annular washers 121 of the bearing unit 12 is received in the annular insertion groove 115 of the lower connecting rod 11 and the annular insertion groove 135 of the upper connecting rod 13 respectively. Then, the pivot seat 134 of the upper connecting rod 13 is inserted into the insertion recess 113 of the lower connecting rod 11, so that the pivot section 131 of the upper connecting rod 13 is pivotally mounted on the pivot section 112 of the lower connecting rod 11, with the roller race 122 being sandwiched between the two annular washers 121. Then, the pivot pin 3 is in turn extended through the through hole 136 of the upper connecting rod 13, the bearing unit 12, and the through hole 116 of the lower connecting rod 11, so that the upper connecting rod 13 is pivotally mounted on the lower connecting rod 11.

Then, the lower end of the upright rod 15 is extended through the passage hole 143 of the locking member 14 and is mounted on the insertion section 132 of the upper connecting rod 13, with the insertion section 132 of the upper connecting rod 13 being inserted into the mounting hole 151 of the upright rod 15, so that the upright rod 15 is combined with the upper connecting rod 13. Then, the catch ring 163 is secured on a lower end the movable member 16 to move therewith. Then, the catch ring 163 and the movable member 16 are slidably mounted on the upright rod 15.

Thus, the movable member 16 can be moved on the upright rod 15 upward and downward, and can be rotated on the upright rod 15 in a horizontal manner.

When the movable member 16 is rotated on the upright rod 15 in a first direction (such as rightward), the outer diameter of the elastic ring 152 on the upper end of the upright rod 15 is expanded outward to urge the inner wall the movable member 16, so that the movable member 16 is fixed and cannot be moved on the upright rod 15 upward and downward.

Alternatively, when the movable member 16 is rotated on the upright rod 15 in a second direction (such as leftward), the outer diameter of the elastic ring 152 on the upper end of the upright rod 15 is retracted inward to detach from the inner wall the movable member 16, so that the movable member 16 can be freely moved on the upright rod 15 upward and downward.

Figure 3:
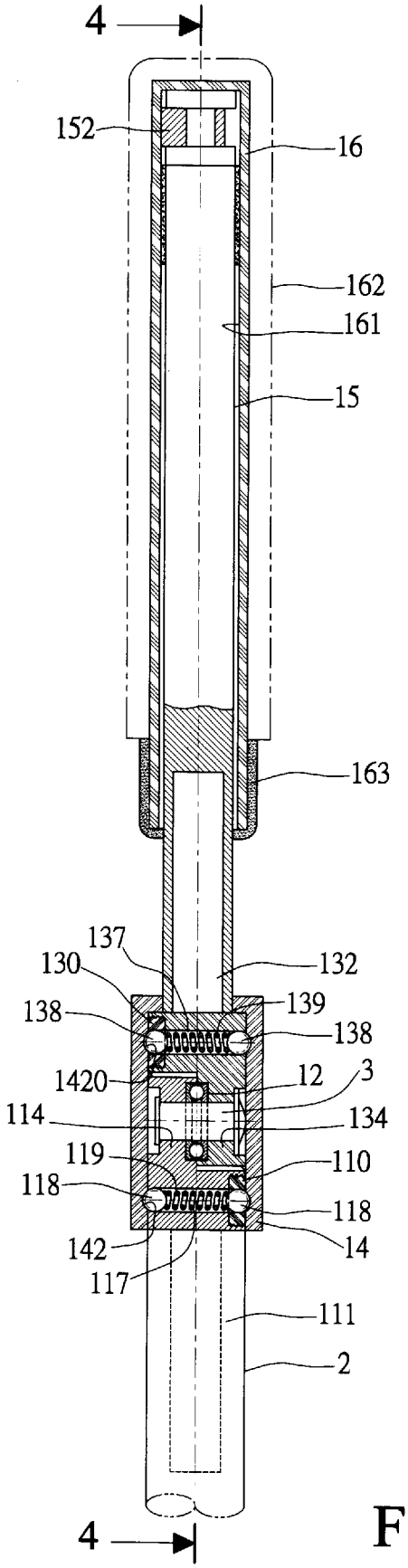
FIG. 3 is a side plan cross-sectional view of the linear putter device of a golf club as shown in FIG. 1.
Figure 4:
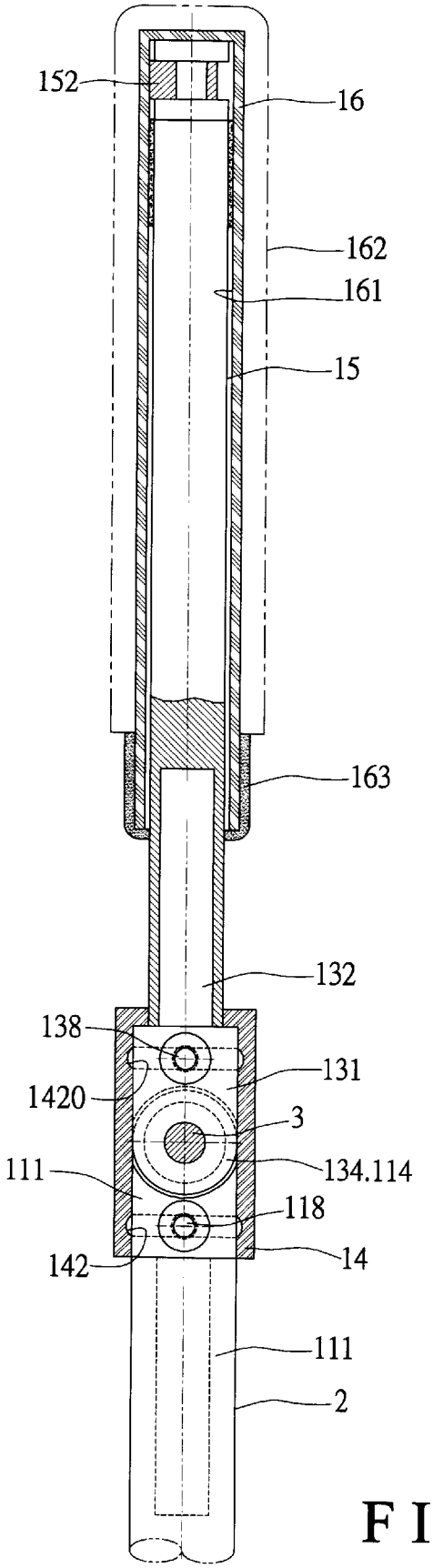
FIG. 4 is a cross-sectional view of the linear putter device of a golf club taken along line 4—4 as shown in FIG. 3.
Figure 5:
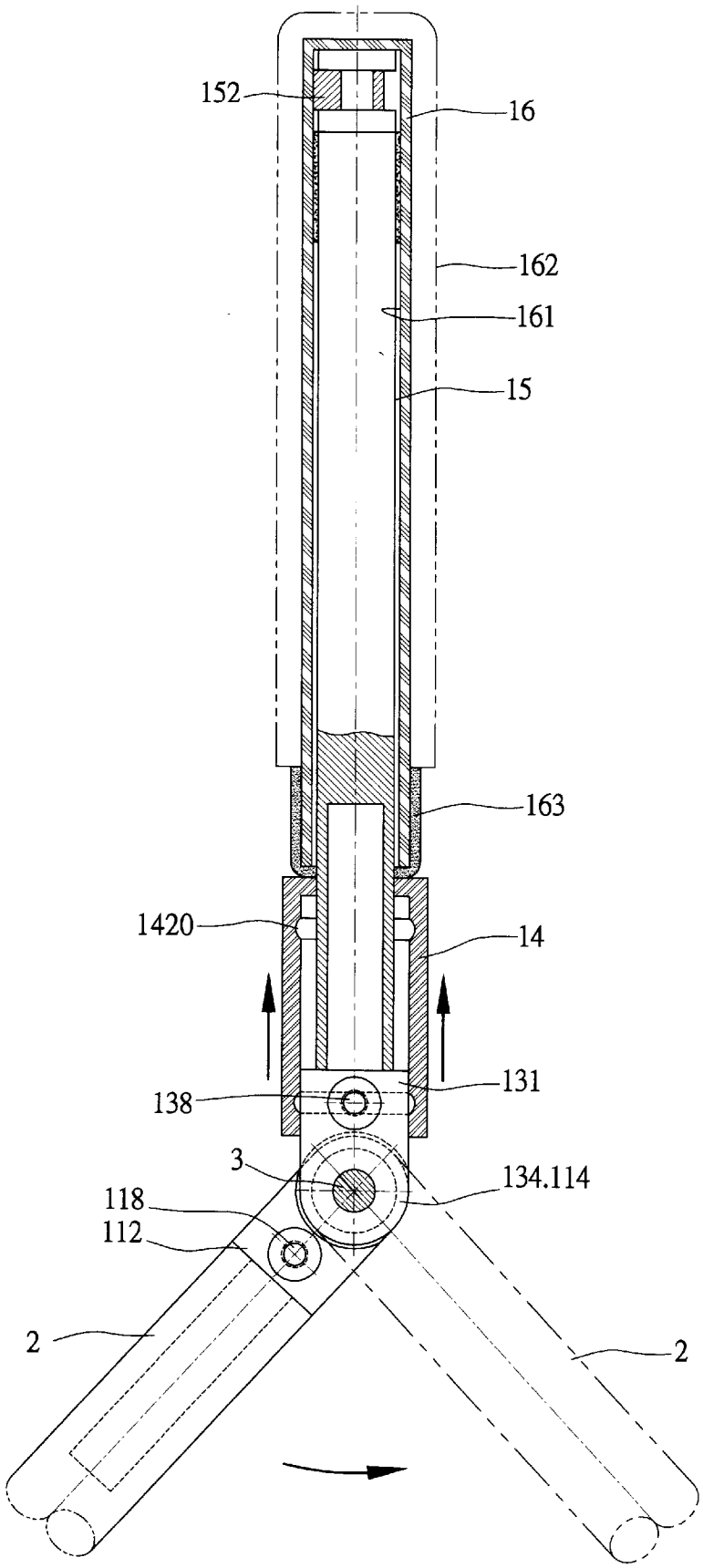
FIG. 5 is a schematic operational view of the linear putter device of a golf club as shown in FIG. 4 in use.
Figure 6:
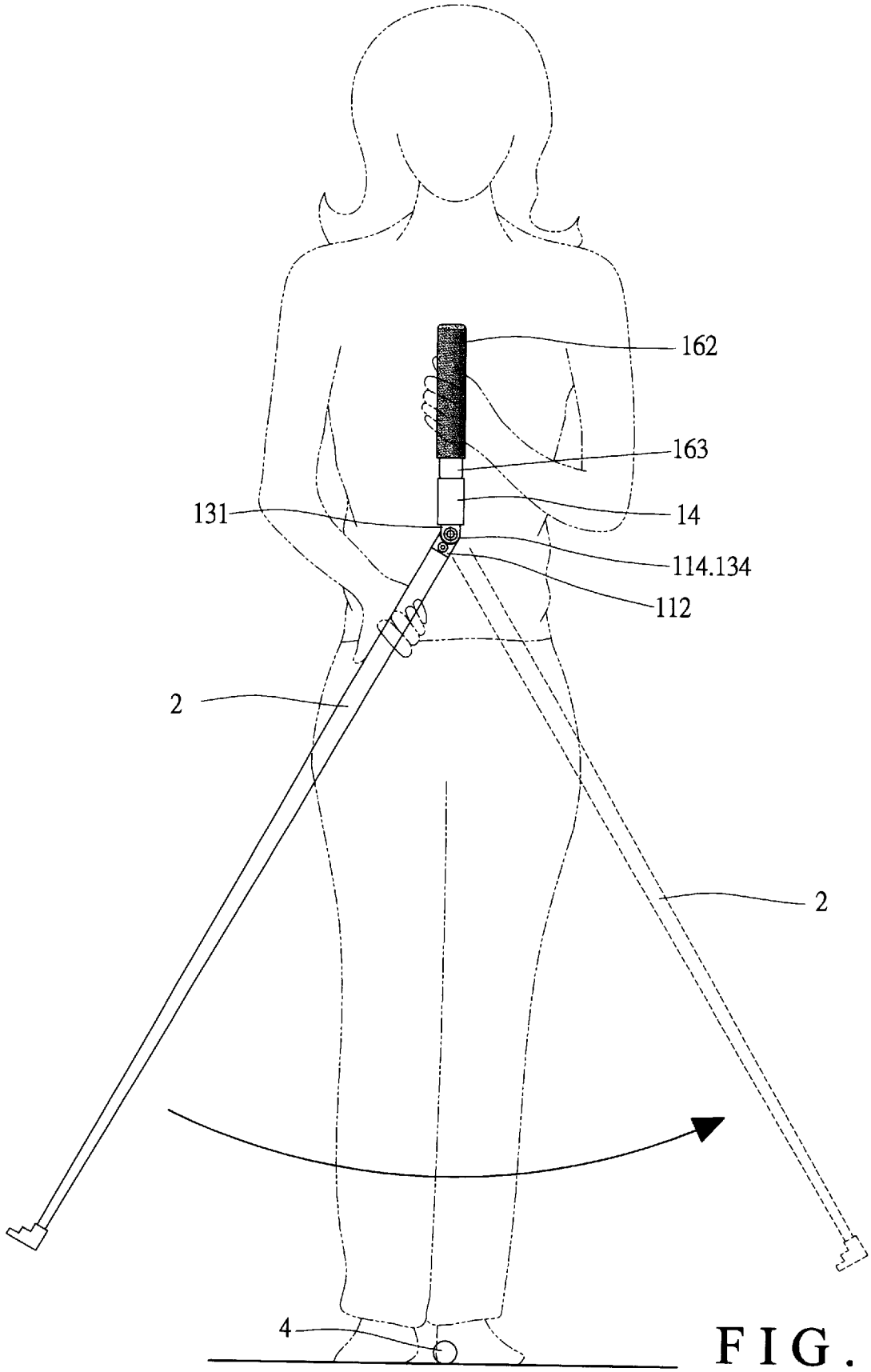
FIG. 6 is a schematic plan operational view of the linear putter device of a golf club in accordance with the preferred embodiment of the present invention.

In operation, referring to FIGS. 5 and 6 with reference to FIGS. 1–4, when the locking member 14 is moved downward on the upright rod 15 to the position as shown in FIGS. 3 and 4, the two first locking balls 118 are inserted into the annular insertion groove 142 of the locking member 14, and the two second locking balls 138 are inserted into the annular insertion groove 1420 of the locking member 14. At this time, the lower connecting rod 111 and the upper connecting rod 13 are locked by the locking member 14, so that the golf club 2 is in line with the upright rod 15 without deflection.

Alternatively, when the locking member 14 is moved upward on the upright rod 15 to the position as shown in FIGS. 5 and 6, the lower connecting rod 11 is detached from the locking member 14, so that the lower connecting rod 11 is pivoted relative to the upper connecting rod 13, and the golf club 2 is pivoted relative to the upright rod 15 as shown in FIGS. 5 and 6 to perform an oscillation action like a pendulum.

In such a manner, the user can hold linear putter device 1, with his/her one hand holding the soft rubber grip 162 and the movable member 16, and with his/her other hand holding and pushing the golf club 2, so that the golf club 2 is pivoted relative to the upright rod 15 to move in a linear manner, so that the golf club 2 can hit the golf ball 4 in a linear manner.

Figure 7:
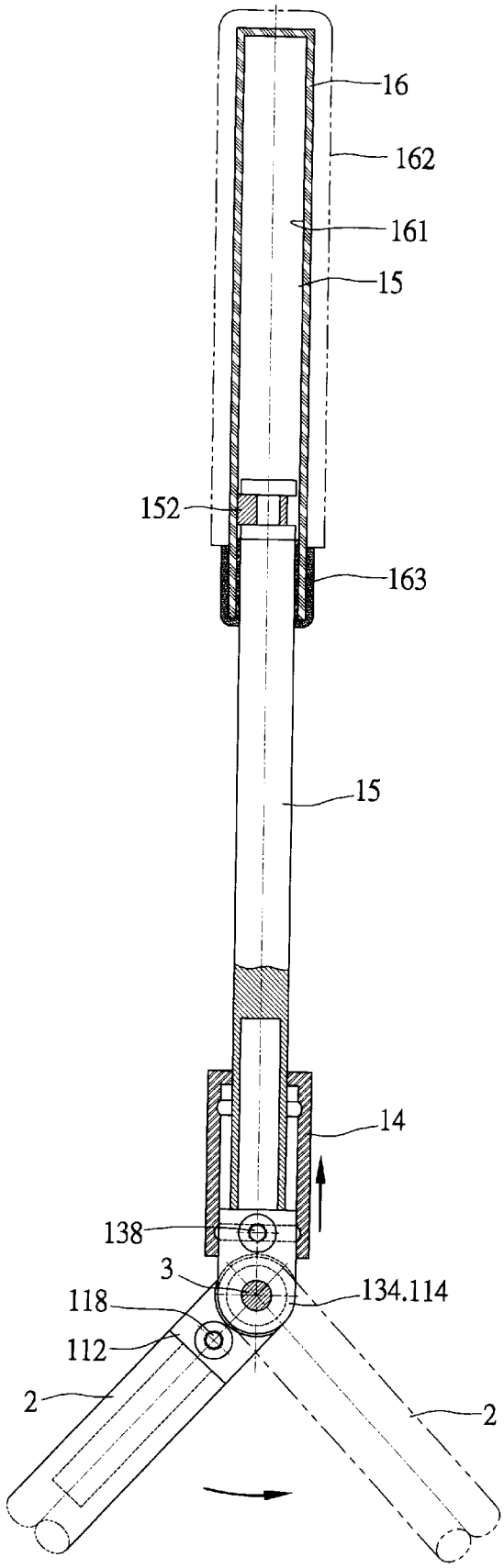
FIG. 7 is a schematic operational view of the linear putter device of a golf club as shown in FIG. 5 in adjustment.
Figure 8:
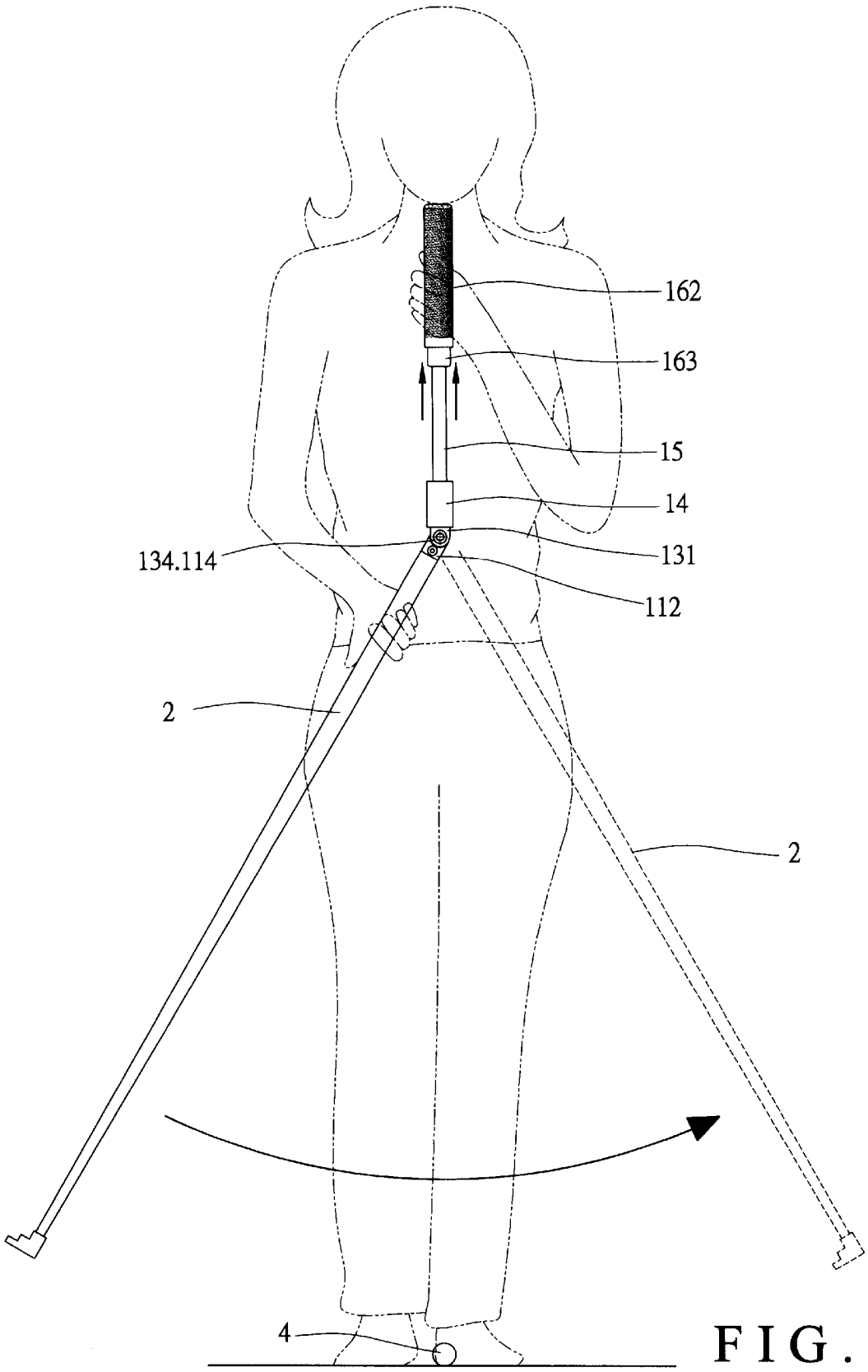
FIG. 8 is a schematic operational view of the linear putter device of a golf club as shown in FIG. 6 in adjustment.

On the other hand, referring to FIGS. 7 and 8 with reference to FIGS. 1–4, when the movable member 16 is rotated on the upright rod 15 in the second direction (leftward), the outer diameter of the elastic ring 152 on the upper end of the upright rod 15 is retracted inward to detach from the inner wall the movable member 16, so that the movable member 16 can be freely moved on the upright rod 15 upward and downward, so that the distance between the movable member 16 and the upright rod 15 can be adjusted arbitrarily so as to fit the user's stature and height.

After adjustment of the distance between the movable member 16 and the upright rod 15, the movable member 16 is rotated on the upright rod 15 in the first direction (rightward). Thus, the outer diameter of the elastic ring 152 on the upper end of the upright rod 15 is expanded outward to urge the inner wall the movable member 16, so that the movable member 16 is fixed and cannot be moved on the upright rod 15 upward and downward.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A linear putter device of a golf club, comprising a lower connecting rod, an upper connecting rod, a bearing unit, a locking member, an upright rod, and a movable member, wherein:

the lower connecting rod has a lower end formed with an insertion section and an upper end formed with a pivot section, the pivot section of the lower connecting rod has an upper portion which has a first half formed with an arc-shaped insertion recess and a second half formed with a pivot seat, the pivot seat of the lower connecting rod has an inner wall formed with an annular insertion groove, the pivot section of the lower connecting rod has a lower portion formed with a receiving chamber for receiving two first locking balls and a first compression spring;

the upper connecting rod is pivotally mounted on the lower connecting rod and has an upper end formed with an insertion section and a lower end formed with a pivot section pivotally mounted on the pivot section of the lower connecting rod, the pivot section of the upper connecting rod has a lower portion which has a first half formed with an arc-shaped insertion recess for insertion of the pivot seat of the lower connecting rod and a second half formed with a pivot seat inserted into the insertion recess of the lower connecting rod, the pivot seat of the upper connecting rod has an inner wall formed with an annular insertion groove, the pivot section of the upper connecting rod has an upper portion formed with a receiving chamber for receiving two second locking balls and a second compression spring;

the bearing unit is mounted in the annular insertion groove of the lower connecting rod and the annular insertion groove of the upper connecting rod;

the locking member is detachably mounted on the lower connecting rod and the upper connecting rod, and has an inner wall having a lower end formed with an annular insertion groove for insertion of the two first locking balls and an upper end formed with an annular insertion groove for insertion of the two second locking balls;

the upright rod has a lower end extended through the locking member and secured on the upper connecting rod; and the movable member is slidably mounted on the upright rod.

2. The linear putter device of a golf club in accordance with claim 1, wherein the insertion section of the lower connecting rod is inserted into the top end of the golf club.

3. The linear putter device of a golf club in accordance with claim 1, wherein the pivot seat of the lower connecting rod has a center formed with a through hole, and the pivot seat of the upper connecting rod has a center formed with a through hole for passage of a pivot pin which is extended through the through hole of the lower connecting rod, so that the upper connecting rod is pivotally mounted on the lower connecting rod.

4. The linear putter device of a golf club in accordance with claim 3, wherein the pivot pin is extended through the bearing unit.

5. The linear putter device of a golf club in accordance with claim 1, wherein the first compression spring is urged between the two first locking balls.

6. The linear putter device of a golf club in accordance with claim 1, further comprising a threaded first end cap screwed into an outer end of the receiving chamber of the lower connecting rod.

7. The linear putter device of a golf club in accordance with claim 6, wherein the first end cap is formed with a through hole for allowing protrusion of one of the two first locking balls.

8. The linear putter device of a golf club in accordance with claim 1, wherein the second compression spring is urged between the two second locking balls.

9. The linear putter device of a golf club in accordance with claim 1, further comprising a threaded second end cap screwed into an outer end of the receiving chamber of the upper connecting rod.

10. The linear putter device of a golf club in accordance with claim 9, wherein the second end cap is formed with a through hole for allowing protrusion of one of the two second locking balls.

11. The linear putter device of a golf club in accordance with claim 1, wherein the bearing unit includes two annular washers and a roller race mounted between the two annular washers.

12. The linear putter device of a golf club in accordance with claim 11, wherein each of the two annular washers of the bearing unit is formed with an annular groove, and the roller race of the bearing unit is provided with a plurality of rollers rotatably mounted in the annular groove of each of the two annular washers.

13. The linear putter device of a golf club in accordance with claim 1, wherein the inner wall of the locking member is formed with a mounting hole for receiving the pivot section of the lower connecting rod and the pivot section of the upper connecting rod.

14. The linear putter device of a golf club in accordance with claim 13, wherein the locking member has an upper end face formed with a passage hole communicating with the mounting hole for passage of the upright rod.

15. The linear putter device of a golf club, in accordance with claim 1, wherein the lower end of the upright rod is formed with a mounting hole for insertion of the insertion section of the upper connecting rod.

16. The linear putter device of a golf club in accordance with claim 1, further comprising an elastic ring mounted on an upper end of the upright rod.

17. The linear putter device of a golf club in accordance with claim 1, wherein the movable member has an inner wall formed with a receiving hole for receiving the upright rod.

18. The linear putter device of a golf club in accordance with claim 1, further comprising a soft rubber grip mounted on an outer wall of the movable member, and a catch ring slidably mounted on the upright rod and secured on a lower end the movable member to move therewith.

* * * * *